US011041283B2

(12) United States Patent
Gabriel

(10) Patent No.: US 11,041,283 B2
(45) Date of Patent: Jun. 22, 2021

(54) SLURRY WALL GRAB HAVING A HYBRID DRIVE

(71) Applicant: Liebherr-Werk Nenzing GmbH, Nenzing (AT)

(72) Inventor: Florian Gabriel, Nenzing (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 299 days.

(21) Appl. No.: 15/966,243

(22) Filed: Apr. 30, 2018

(65) Prior Publication Data

US 2019/0127948 A1 May 2, 2019

(30) Foreign Application Priority Data

May 3, 2017 (DE) ..... 10 2017 004 270.5

(51) Int. Cl.

| | |
|---|---|
| ***E02F 3/47*** | (2006.01) |
| ***E02F 3/14*** | (2006.01) |
| ***B66C 3/16*** | (2006.01) |
| ***B66C 3/12*** | (2006.01) |
| ***E02D 17/13*** | (2006.01) |
| ***B66C 3/06*** | (2006.01) |
| ***E02F 3/413*** | (2006.01) |

(52) U.S. Cl.

CPC ..... *E02F 3/147* (2013.01); *B66C 3/06* (2013.01); *B66C 3/125* (2013.01); *B66C 3/16* (2013.01); *E02D 17/13* (2013.01); *E02F 3/413* (2013.01)

(58) Field of Classification Search

CPC ..... E02F 3/47; E02F 3/413; A01B 61/046; E02D 17/13

See application file for complete search history.

(56) References Cited

U.S. PATENT DOCUMENTS

| | | | | | |
|---|---|---|---|---|---|
| 2,188,672 | A | * | 1/1940 | Atkinson | E02F 3/47 37/186 |
| 2,486,479 | A | * | 11/1949 | Kennedy | B66C 3/20 414/726 |
| 2,676,052 | A | * | 4/1954 | Mittry, Jr. | B66C 3/16 294/206 |
| 3,103,753 | A | * | 9/1963 | Takacs | B66C 3/16 37/187 |
| 3,479,077 | A | * | 11/1969 | Spears | E02F 3/47 294/68.23 |
| 3,516,433 | A | * | 6/1970 | Guinot | F16L 3/01 137/355.26 |
| 3,574,387 | A | * | 4/1971 | Hahn | B66C 3/16 294/198 |
| 3,695,473 | A | * | 10/1972 | Martin | B66C 13/06 414/625 |

(Continued)

FOREIGN PATENT DOCUMENTS

| | | |
|---|---|---|
| DE | 1235547 B | 3/1967 |
| DE | 3615068 C1 | 10/1987 |

(Continued)

*Primary Examiner* — Jessica H Lutz

(74) *Attorney, Agent, or Firm* — Dilworth & Barrese, LLP

(57) ABSTRACT

A slurry wall grab has a hybrid drive in turn having at least one pulley block, at least one hydraulic actuator, and at least one energy store. The hydraulic actuator and the pulley block open and/or close a grab jaw of the slurry wall grab. The energy store can be charged by actuating the pulley block.

15 Claims, 1 Drawing Sheet

(56) References Cited

U.S. PATENT DOCUMENTS 3,750,770 A * 8/1973 Botto ..... E02F 3/413 175/173
3,949,498 A * 4/1976 Iwata ..... B66C 3/02 37/187
4,012,856 A * 3/1977 Schwarz ..... B66C 3/00 37/187
4,381,872 A * 5/1983 Hahn ..... B66C 3/06 294/111
4,526,413 A * 7/1985 Williams ..... B66C 13/40 294/198
5,443,294 A * 8/1995 Prinz ..... B66C 3/16 294/68.23
5,649,729 A * 7/1997 Peterson ..... B66C 3/06 254/337
5,707,182 A * 1/1998 Letter ..... E02D 17/13 405/267
5,836,089 A * 11/1998 Lipsker ..... B66C 3/02 37/186
10,174,476 B2 * 1/2019 Luong ..... E02D 17/13
2004/0168831 A1 * 9/2004 Nozaki ..... E02F 3/47 175/267
2008/0179069 A1 * 7/2008 Loeffelholz ..... E02F 3/413 172/35
2015/0128458 A1 * 5/2015 Trevisani ..... E02D 17/13 37/184
2016/0167931 A1 * 6/2016 Carneiro ..... B66C 3/02 254/390
2017/0166421 A1 * 6/2017 Rothmann ..... B66C 13/22

FOREIGN PATENT DOCUMENTS

DE 4324956 A1 1/1995
DE 4327463 A1 3/1995

* cited by examiner

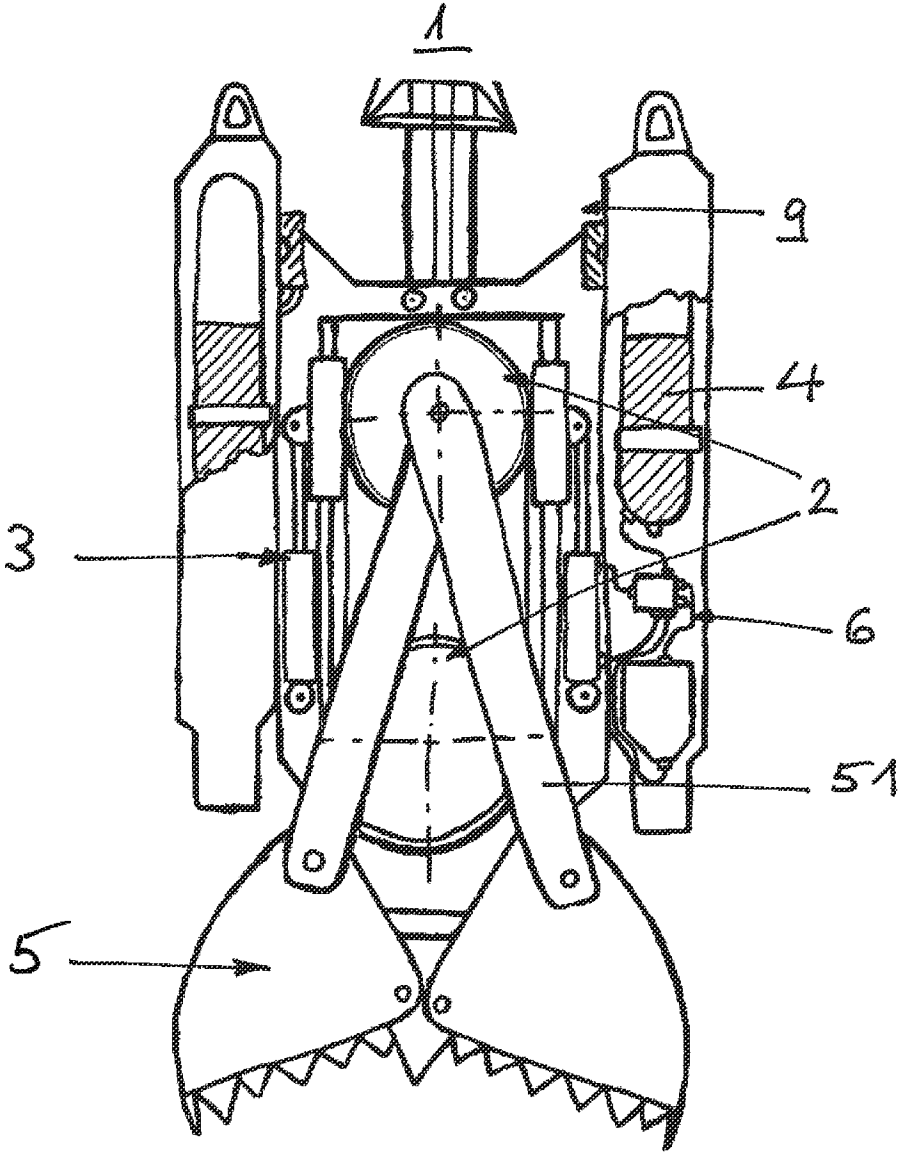
1
9
4
2
6
51
3
5

SLURRY WALL GRAB HAVING A HYBRID DRIVE

The invention relates to a slurry wall grab having a hybrid drive comprising at least one pulley block, at least one hydraulic actuator, and at least one energy store, wherein the hydraulic actuator and the pulley block are configured to open and/or close a grab jaw of the slurry wall grab, and wherein the energy store can be charged by actuating the pulley block.

BACKGROUND OF THE INVENTION

There is the disadvantage with known slurry wall grabs that the penetration force of the grab is dependent on its weight and in particular in situations with increased closing force requirements, e.g. on the excavation of particularly hard ground, the penetration force required for this purpose is not reached or a loss of penetration force is otherwise induced.

The reasons for this can be that the force applied by the hoist winch works against the penetration force or the weight force of the slurry wall grab. The closing force is here, as is known, introduced into the grab by means of the hoist winch and is thus also dependent on the sheeving of the pulley block used.

SUMMARY OF THE INVENTION

Against this background, it is the object of the invention to provide an improved slurry wall grab that can in particular exert an increased closing force on the carrying out of grabbing work.

This object is achieved in accordance with the invention by a slurry wall grab having a hybrid drive and the features herein. Advantageous embodiments are also the subject herein.

Accordingly, a slurry wall grab having a hybrid drive is provided comprising at least one pulley block, at least one hydraulic actuator, and at least one energy store, wherein the hydraulic actuator and the pulley block are configured to open and/or close a grab jaw of the slurry wall grab, and wherein the energy store can be charged by actuating the pulley block.

It is advantageously possible with the slurry wall grab in accordance with the invention to convert mechanical energy or lifting energy on the closing and/or opening of the grab jaw, in particular outside the trench generated by the slurry wall grab, into hydraulic energy and thereby to transfer energy from a carrier device of the slurry wall grab such as from a crane to the slurry wall grab without having to provide additional energy transfer devices for this purpose. A rope of the pulley block that runs between the pulley block and the carrier device can in particular be used for the energy transfer.

There is the possibility of a hybrid operation of the slurry wall grab due to the utilization of the transferred energy and of the hydraulic actuator. A hybrid operation is generally understood as the combination or mixture of different technologies. In the present case, a closed, self-sufficient hydraulic circuit can assist the mechanical basic principle of the function of the pulley block and can thus require a hybrid manner of construction.

Provision can be made in a preferred embodiment that the energy store comprises at least one gas accumulator. The energy store can be formed within the same housing, in particular produced in one piece, as the hydraulic actuator and/or can be encompassed by the hydraulic actuator.

It is conceivable in a further preferred embodiment that the pulley block is configured to charge the energy store by actuating the hydraulic actuator. The pulley block and the hydraulic actuator can for this purpose be mechanically coupled to one another, for example via the grab jaw and/or via a linkage of the grab jaw. The hydraulic actuator can accordingly be configured to convert from hydraulic energy into mechanical energy and conversely to convert from mechanical energy into hydraulic energy.

Provision can further be made that the hydraulic actuator and the ropes of the pulley block are arranged in parallel with one another. It is in particular conceivable that two pulleys of the pulley block arranged displaceably with respect to one another are displaceable relative to one another both by means of the rope of the pulley block and by means of the hydraulic actuator.

It is conceivable in a further preferred embodiment that the pulley block is configured to charge the energy store on the opening and/or closing of the grab jaw.

In a further preferred embodiment, at least one valve, in particular a remote-controllable valve, can be provided to control the hydraulic actuator and/or the energy store. The valve can be configured to set a hydraulic connection between the hydraulic actuator and the energy store such that the energy store is charged with hydraulic energy by the hydraulic actuator on the closing and/or opening of the grab jaw and/or such that the energy store provides the hydraulic actuator with energy to close the grab jaw.

Provision can here be made in a particularly preferred embodiment that the valve can be controlled via radio and/or via a hoist rope comprising an electrical conductor.

The valve can here be coupled via radio and/or via the hoist rope to, for example, a regulator/control of a carrier device of the slurry wall grab. The regulator/control can cause a charging of the energy store and/or the carrying out of movements of the hydraulic actuator by a corresponding control/regulation of the valve. The hoist rope can be a rope for holding or hoisting the slurry wall grab. It can be a rope different from the rope of the pulley block.

It is conceivable in a further preferred embodiment that the valve is a proportional valve, in particular an electromagnetic proportional valve. Provision can furthermore also be made that the slurry wall grab comprises hydraulically adjustable guide elements. The guide elements can be utilized to guide the slurry wall grab within the trench dug by the slurry wall grab and thereby to establish a desired slurry geometry.

Provision can here be made in a particularly preferred embodiment that the energy store is configured to supply the guide elements with energy. The guide elements can accordingly also be indirectly supplied via the pulley block with energy that can be provided by a carrier device.

Provision can be made in a further preferred embodiment that at least two hydraulic actuators are provided. Such an embodiment having more than one hydraulic actuator makes possible a particularly uniform force transfer from the hydraulic actuators to the pulley block and vice versa. The hydraulic actuators can be arranged symmetrically around the pulley block to make possible a force distribution that is as uniform as possible.

BRIEF DESCRIPTION OF THE DRAWING

Further details and advantages of the invention are explained with reference to the embodiment shown by way of example in the FIGURE.

DESCRIPTION OF THE PREFERRED EMBODIMENT

The only FIGURE shows a side view of a slurry wall grab 1 in accordance with the invention having a hybrid drive. The hybrid drive comprises a pulley block 2 that is in particular arranged in parallel with at least one hydraulic actuator 3. The hydraulic actuator 3 can comprise at least one hydraulic cylinder or at least one hydraulic cylinder-piston apparatus.

In the embodiment of the FIGURE, the pulley block 2 is substantially encompassed by two hydraulic actuators 3. I.e. the pulley block can be arranged between the hydraulic actuators 3. The hydraulic actuators 3 can be arranged tangentially to the pulleys and/or spaced apart from the axes of rotation of the pulleys. At least one coupling section via which the hydraulic actuator 3 can be coupled to at least one of the pulleys can be provided for this purpose at at least one of the pulleys, arranged radially outwardly thereat.

A first pulley of the pulley block 2 is coupled via a linkage 51 to two halves of a grab jaw 5 in the embodiment of the FIGURE. This first pulley can be arranged further away from the grab jaws 5 than a second pulley of the pulley block. The first pulley can be configured as displaceable with respect to the remaining structure of the slurry wall grab 1, while the second pulley can be configured as not displaceable with respect to the remaining structure of the slurry wall grab 1, or vice versa. The linkage 51 can also be coupled to the second pulley instead of to the first.

The halves of the grab jaw 5 can be pivoted relative to one another by changing the spacing between the first pulley 5 and the second pulley of the pulley block. Provision can be made here that a decrease or an increase of the spacing closes the grab jaws 5.

The slurry wall grab 1 can furthermore comprise at least one energy store 4 that can be formed as a gas accumulator. The energy store 4 is coupled to the at least one hydraulic actuator 3. The hydraulic actuator 3 is configured, like the pulley block 2 itself, to change the spacing between the two pulleys of the pulley block 2.

The energy store 4 can be arranged in an outer region of the slurry wall grab 1 and/or in an upper region of the slurry wall grab 1. The energy store 4 can in particular be arranged within outer frame parts of the slurry wall grab 1.

When the grab jaw 5 is to be closed with an increased force to grab material, both the hydraulic actuator 3 and the pulley block 2 can be controlled to reduce the spacing of the two pulleys of the pulley block 2.

A valve can be correspondingly controlled for this purpose, for example, such that hydraulic fluid flows from the energy store 4 into the hydraulic actuator 3 and a rope of the pulley block 2 can be coiled over a winch, for example, such that the two pulleys are moved toward one another by the rope and by the hydraulic actuator 3.

The term of the grab jaw 5 can in the present case comprise the two jaw halves of the grab jaw 5 shown in the FIGURE.

To charge the energy store 4, the arrangement of the hydraulic actuator and of the energy store can be controlled via a valve such that the hydraulic actuator 3 is used for charging the energy store 4. The mechanical energy that is introduced via the rope into the pulley block 2 to adjust the pulleys of the pulley block 2 is here converted by means of the hydraulic actuator 3 into hydraulic energy in the energy store 4.

Alternatively or additionally, it is also conceivable that an energy converter different from the hydraulic actuator is provided by means of which the energy store 4 can be charged.

The valve 6 used here can be controllable for switching via radio and/or via a hoist rope comprising an electrical line. The control via a corresponding hoist rope brings along the advantage that the control is also possible within deep trenches and is not restricted by the range of a radio transmitter.

The slurry wall grab 1 can furthermore in particular comprise hydraulically adjustable and/or modular guide elements 9 that guide the slurry wall grab 1 within a trench dug by it. The guide elements 9 or their hydraulic drive or their hydraulic drives can be coupled with the energy store 4 of the slurry wall grab 1 to be supplied with energy by it.

Since the energy store 4 can be charged with hydraulic energy as described above, the invention provides the possibility of utilizing the energy stored in this manner for carrying out a hydraulic verticality correction by means of the guide elements 9. There is thus the possibility of providing a self-sufficient verticality correction that provides the same or similar advantages to the closing force amplification achievable in accordance with the invention.

The basic concept of the above-described hybrid grab is based on a mechanical slurry wall grab. The pulley block is assisted by hydraulic cylinders to increase its excavating force or to increase the weight force of the grab in the closing procedure with the same excavation force and thus to improve the excavation behavior in hard ground.

The energy for the hydraulic cylinders is converted from mechanical energy into hydraulic energy on the opening and closing procedure without resistance, e.g. outside the trench, and is buffered, for example in a gas accumulator. The system is thereby self-sufficient from the carrier system. The signals for the control of the electromagnetic proportional valves are transmitted via radio or via a special hoist rope including electrical conductors. The radio transmission may, however, only be possible outside the trench. The hydraulic energy can also be made use of for the adjustment of the hydraulic adjustment cylinders of the guide frames or of guide elements 9.

The invention claimed is:

1. A slurry wall grab (1) having a hybrid drive, comprising a grab jaw (5), a rope pulley block comprising a pair of pulleys (2), at least one hydraulic actuator (3), at least one energy store (4) for hydraulic fluid in said at least one hydraulic actuator (3), a pair of linkages (51), with each said linkage (51) coupled to a respective halve of said grab jaw (5) and also coupled to a first pulley of said pair of pulleys (2), said first pulley arranged to be displaceable towards and away from a second pulley of said pair of pulleys (2) and which is non-displaceable, with said pulleys (2, 2) mounted at different distances from said grab jaw (5), wherein the hydraulic actuator (3) is coupled to the displaceably-arranged pulley (2) of the pulley block to open and to close the grab jaw (5) of the slurry wall grab (1), the energy store (4) is chargeable by actuating the pulley block (2), and the first displaceably-arranged pulley (2) is situated further away from the grab jaw (5) than the second non-displaceable pulley (2).

2. The slurry wall grab (1) in accordance with claim 1, wherein the pulley block (2) is configured to charge the energy store (4) by actuating the hydraulic actuator (3).

3. The slurry wall grab (1) in accordance with claim 1, wherein the pulley block (2) is configured to charge the energy store (4) on the opening or closing of the grab jaw (5).

4. The slurry wall grab (1) in accordance with claim 1, wherein the slurry wall grab comprises hydraulically adjustable guide elements (9).

5. The slurry wall grab (1) in accordance with claim 4, wherein the energy store (4) is configured to supply the guide elements (9) with energy.

6. The slurry wall grab in accordance with claim 1, wherein at least two hydraulic actuators are provided.

7. The slurry wall grab in accordance with claim 1, wherein both linkages (51) are directly-coupled to the first displaceably-arranged pulley (2).

8. A slurry wall grab (1) having a hybrid drive, comprising a grab jaw (5), a rope pulley block comprising a pair of pulleys (2), at least one hydraulic actuator (3), at least one energy store (4) for hydraulic fluid in said at least one hydraulic actuator (3), a pair of linkages (51), with each said linkage (51) coupled to a respective halve of said grab jaw (5) and also coupled to one of said pair of pulleys (2) which is arranged to be displaceable, with said pulleys (2, 2) mounted at different distances from said grab jaw (5), wherein the hydraulic actuator (3) is coupled to the displaceably-arranged pulley (2) of the pulley block to open and to close the grab jaw (5) of the slurry wall grab (1), the energy store (4) is chargeable by actuating the pulley block (2), and the energy store (4) comprises at least one gas accumulator.

9. A slurry wall grab (1) having a hybrid drive, comprising a grab jaw (5), a rope pulley block comprising a pair of pulleys (2), at least one hydraulic actuator (3), at least one energy store (4) for hydraulic fluid in said at least one hydraulic actuator (3), a pair of linkages (51), with each said linkage (51) coupled to a respective halve of said grab jaw (5) and also coupled to one of said pair of pulleys (2) which is arranged to be displaceable, with said pulleys (2, 2) mounted at different distances from said grab jaw (5), wherein the hydraulic actuator (3) is coupled to the displaceably-arranged pulley (2) of the pulley block to open and to close the grab jaw (5) of the slurry wall grab (1), the energy store (4) is chargeable by actuating the pulley block (2), and at least one valve (6) is provided to control the hydraulic actuator (3) or the energy store (4).

10. The slurry wall grab (1) in accordance with claim 9, wherein the valve (6) is controllable via radio or a hoist rope comprising an electrical conductor.

11. The slurry wall grab (1) in accordance with claim 9, wherein the valve (6) is a proportional valve.

12. The slurry wall grab in accordance with claim 11, wherein the valve (6) is an electromagnetic proportional valve.

13. The slurry wall grab in accordance with claim 9, wherein the valve (6) is remote-controllable.

14. A slurry wall grab having a hybrid drive, comprising a grab jaw (5), a rope pulley block comprising a pair of pulleys (2), at least one hydraulic actuator (3), at least one energy store (4) for hydraulic fluid in said at least one hydraulic actuator (3), a pair of linkages (51), with each said linkage (51) coupled to a respective halve of said grab jaw (5) and also coupled to one of said pair of pulleys (2) which is arranged to be displaceable, with said pulleys (2, 2) mounted at different distances from said grab jaw (5), wherein the hydraulic actuator (3) is coupled to the displaceably-arranged pulley (2) of the pulley block to open and to close the grab jaw (5) of the slurry wall grab (1), the energy store (4) is chargeable by actuating the pulley block (2), at least two hydraulic actuators are provided, and said actuators (3,3) are laterally arranged on opposite sides of the pulley block (2).

15. The slurry wall grab in accordance with claim 14, comprising a pair of energy stores (4), with the energy stores (4) laterally arranged on opposite sides of the pulley block (2).

* * * * *